US012546210B2

(12) United States Patent
Ramírez Ozuna

(10) Patent No.: US 12,546,210 B2
(45) Date of Patent: Feb. 10, 2026

(54) DEVICE AND SYSTEM FOR ORIENTING CORE SAMPLES

(71) Applicant: STOCKHOLM PRECISION TOOLS, S.L., Malaga (ES)

(72) Inventor: Orlando Rene Ramírez Ozuna, Malaga (ES)

(73) Assignee: STOCKHOLM PRECISION TOOLS, S.L., Malaga (ES)

( * ) Notice: Subject to any disclaimer, the term of this patent is extended or adjusted under 35 U.S.C. 154(b) by 0 days.

(21) Appl. No.: 18/940,630

(22) Filed: Nov. 7, 2024

(65) Prior Publication Data

US 2025/0059881 A1 Feb. 20, 2025

Related U.S. Application Data

(63) Continuation-in-part of application No. 17/955,257, filed on Sep. 28, 2022, now abandoned.

(30) Foreign Application Priority Data

Sep. 29, 2021 (ES) ..... ES202131925U

(51) Int. Cl.

| | |
|---|---|
| ***E21B 25/16*** | (2006.01) |
| ***E21B 25/10*** | (2006.01) |
| ***E21B 47/024*** | (2006.01) |
| ***E21B 47/12*** | (2012.01) |

(52) U.S. Cl.

CPC ..... *E21B 47/024* (2013.01); *E21B 25/10* (2013.01); *E21B 47/12* (2013.01)

(58) Field of Classification Search

None

See application file for complete search history.

(56) References Cited

U.S. PATENT DOCUMENTS

| | | | | |
|---|---|---|---|---|
| 7,584,055 | B2 | 9/2009 | Parfitt | |
| 2012/0037421 | A1 | 2/2012 | Parfitt | |
| 2014/0008968 | A1* | 1/2014 | Moeny | E21B 7/15 307/106 |
| 2017/0022793 | A1* | 1/2017 | Kravets | E21B 43/2405 |
| 2017/0089153 | A1* | 3/2017 | Teodorescu | E21B 43/10 |
| 2019/0055835 | A1* | 2/2019 | Brookes | H04Q 9/02 |

(Continued)

FOREIGN PATENT DOCUMENTS

| | | | | |
|---|---|---|---|---|
| EP | 2134921 | B1 * | 9/2017 | E21B 25/16 |
| WO | 2007137356 | A1 | 12/2007 | |

*Primary Examiner* — Tara Schimpf
*Assistant Examiner* — Ursula Lee Norris
(74) *Attorney, Agent, or Firm* — Thedford I. Hitaffer; Hitaffer, PLLC

(57) ABSTRACT

A device for orienting core samples relative to their position in the subsoil before extraction, attaching to a core bit during drilling features a robust tubular body with a detector to identify core sample breakage and orientation using triaxial accelerometers and gyroscopes, measuring orientation by the gravity vector or true north. An electronic control unit stores, timestamps, and transmits data wirelessly via BLUETOOTH®, ensuring data reliability without removing the device. The device includes adapters for different pipe diameters, minimizing the need for disassembly and reducing user fatigue, while maintaining pump functionality with a bypass valve if needed.

12 Claims, 2 Drawing Sheets

(56) References Cited

U.S. PATENT DOCUMENTS

| | | | | |
|---|---|---|---|---|
| 2021/0040839 | A1* | 2/2021 | Tackmann | E21B 47/0236 |
| 2021/0072420 | A1* | 3/2021 | San Martin | E21B 49/00 |
| 2021/0222541 | A1* | 7/2021 | Tapson | E21B 47/024 |
| 2023/0082354 | A1 | 3/2023 | Ramírez Ozuna | |
| 2024/0337768 | A1* | 10/2024 | Mizuno | E21B 47/04 |

* cited by examiner

DEVICE AND SYSTEM FOR ORIENTING CORE SAMPLES

CROSS-REFERENCE TO RELATED APPLICATIONS

This application is a continuation-in-part application of and claims priority to U.S. Ser. No. 17/955,257 filed Sep. 28, 2022, which is pending and is which is hereby incorporated by reference in its entirety for all purposes.

U.S. Ser. No. 17/955,257 claims priority under 35 U.S.C. 119 to Spanish Utility Model U202131925 filed Sep. 29, 2021, which is hereby incorporated by reference in its entirety for all purposes.

FIELD OF THE INVENTION

The present invention relates to the orientation of core samples retrieved from the subsoil in geological and mining exploration. In particular, the invention relates to a device and system for determining the orientation of any geological structure present based on core samples extracted from drilling relative to the underground environment or subsoil from which said core samples have been obtained. More particularly, the invention provides an efficient way for detecting, recording, and storing data related to the moment of breakage of a core sample during drilling operations.

STATE OF THE ART

One of the main purposes of mineral and geotechnical exploration is the acquisition of geological information, which can be obtained from the extraction of core samples. The main information parameters to obtain includes the orientation of any geological structure present in the extracted rock core. Depending on the objective of the project, mining or geotechnical, it moves forward with the interpretation of the data obtained.

There are mineral deposits that have a structural control associated with economically exploitable areas of interest. Other projects focused on infrastructure, may require structural information to complement the characterisation of the rock mass and make safe designs for the works in progress.

In this sense, various solutions have been provided in the state of the art to determine the characteristics of the geological structure of the soil through the orientation of the core samples obtained during exploration. One of these solutions is disclosed in the U.S. Pat. No. 7,584,055 B2 which provides a core orientation device designed for use in a core drill and includes mechanisms to capture, process, and store information about its physical orientation during drilling. It uses sensors to generate signals related to its orientation, which are processed into usable data. This data is stored in a memory unit and can be accessed later through an interface to provide information on the device's orientation at a specific time, ensuring accurate tracking of the core's position throughout the drilling process.

Other alternatives for core orientation are reflected in patent application U.S. Patent Application Publication 2012/037421 A1 which discloses a core sample orientation system comprising a first portion in the form of a downhole unit adapted to be connected to a core tube of a core drill and a second portion comprising a control unit. The downhole unit is adapted for cooperation with a core tube for recording data relating to the orientation of the core tube, and the control unit is adapted to cooperate with the downhole unit to receive and process orientation data from the downhole unit and provide an indication of the orientation of a core sample within the core tube at a time prior to separation of the core sample from the underground environment from which it was obtained. The downhole unit is configured to cooperate with the control unit to establish an operative connection therebetween. More particularly, the downhole unit and the control unit are configured to provide a coupling for releasably connecting them together in a manner allowing selective rotation therebetween. The coupling comprises a combination of magnetic coupling and mechanical coupling.

The disclosure of the referred patent documents reveals that in both cases it continuously stores data at fixed intervals (e.g., every minute), which could lead to memory exhaustion or the need for manual memory management. As a result, older or redundant data may be unnecessarily retained, consuming memory resources. Besides, the data are recorded at fixed intervals, e.g., one minute, which may result in missed critical data points, especially during events of interest, such as core sample separation from the subsoil. Further, disclosure uses memory that may be volatile, meaning that in case of power loss or system failure, data, especially the critical core sample separation event, could be lost.

Another disadvantage of the aforementioned patent documents is that it is necessary to open the core tube to couple the second portion in which the control unit is located in order to download the data on the orientation of the core sample. Therefore, this process requires several steps that increase the operating times and the fatigue of the operators/users.

Likewise, given the structural configuration of the core sample orientation system of the referenced patent application it is necessary to provide a downhole unit based on the diameter of the core pipe to which it is to be coupled that is, one downhole unit per core tube diameter. This means the system is not very flexible to adapt to the different diameters of existing pipes at the sites.

Therefore, there is a latent need to provide a device/system for orienting core samples that get over all the previously discussed advantages.

SUMMARY OF THE INVENTION

In order to meet the needs previously discussed, the present invention provides a device for orienting core samples relative to the position thereof with respect to the subsoil before being extracted, said device being intended to remain coupled during operation in a core bit, that is, in the bit used to drill and extract the core sample from the subsoil. The proposed device is more efficient, reliable, and adaptive, ensuring crucial data is retained without overburdening memory resources, and also enables an easier transmission to an external device of the data related with orientation of the core sample orientation in regard the prior art.

Preferably, the proposed device comprises a body or tubular body couplable to the inner tube and/or head assembly of a core bit. This tubular body may be a single piece type, being manufactured with sufficiently resistant materials to withstand the stresses of well drilling, as well as to protect the components housed therein and which will be described hereinafter.

Preferably, within the tubular body there is housed a detector configured to detect a breaking or split of the core sample from the subsoil, and also configured to detect an orientation of the inner tube and/or sample provided/caught/placed in the inner tube. In a preferred embodiment, the detector comprises at least a triaxial accelerometer configured to record the vibrations and/or movements of the core bit and/or the drill head, wherein the breaking of the core sample is recorded when the data of the vibrations and/or movements of the core bit are beyond a preset value. In this regard, Preferably, in another embodiment, the detector comprises of a set of triaxial accelerometers arranged mutually orthogonal to each other. In this way, the device of the invention is also capable of orienting the sample based on the gravity vector, carrying out the measurement of the gravitational vector. Alternatively, in the detector, there is a triaxial accelerometer for recording the vibrations and/or movements of the core bit and/or the drill head, and there is a set of triaxial accelerometers arranged mutually orthogonal to each other for orienting the core sample. In another alternative, in the set of set of triaxial accelerometers, all or either of the triaxial accelerometers is further configured to record the vibrations and/or movements of the core bit and/or the drill head.

Alternatively, the detector may include a set of micromechanical gyroscopes arranged mutually orthogonal to each other. Even more preferably, the detector comprises a set of triaxial accelerometers arranged mutually orthogonal to each other and a set of micromechanical gyroscopes arranged mutually orthogonal to each other. With the different configurations of the detector, it is possible to obtain the orientation of the core sample based on the gravity vector, carrying out the measurement of the gravitational vector and/or with respect to the true north of the extracted.

To receive and process the data from the detector relating to the breaking of the core sample and the orientation of the inner tube and/or the core sample placed in the inner tube, the device comprises an electronic control unit arranged in the tubular body, such electronic control unit is further configured to control the detector, to store the data of the breaking of the core sample and to wirelessly transmit said breaking data and the orientation data. Advantageously, storing by electronic control unit the data of the precise moment when core breakage occurs, ensures that the geological data of the subsoil captured during drilling is correctly recorded.

Preferably, the electronic control unit comprises a circular buffer configured to record the data related with the breaking of the core sample and a non-volatile memory configured to store said data. In this regard, the cyclic buffer enhances the continuous recording of recent orientation data, while non-volatile memory provides critical assurance that the core separation event is preserved under all circumstances.

According to this, more preferably, the circular buffer has an adjustable frequency to record the data, wherein the frequency is adjusted among the range of 1 Hz a 0.2 Hz. By allowing the frequency to oscillate between 1 Hz and 0.2 Hz, the device is capable of optimize its storage according to the rate at which data needs to be handled. Further, the cyclic buffer with adjustable frequency ensures no critical data of breaking of the core is lost, as it can hold onto data long enough for processing even during low-frequency operations.

Further, the electronic control unit comprises an internal clock to record the moment of core breaking from the subsoil. Upon detecting the destruction event, the device sets the time on the internal clock and store it for later display and analysis of the orientation of the core. Advantageously, the provision of an internal clock eliminates the need for external time synchronization, making more reliable the data obtained of the core orientation.

In another embodiment, the electronic control unit comprises communication means configured for the wireless transmission of the breaking and orientation data by means of high-speed BLUETOOTH® protocol using high-speed BLUETOOTH® protocol connections has the advantage that it is not necessary to remove the orientation device of the present invention from the inner tube of the core bit to obtain the orientation mark of the core sample. Therefore, the accuracy is maintained and the efficiency in collecting the core orientation data is increased. Furthermore, the fact that no piece of the device is disassembled to collect orientation data adds reliability and quality control, making the process auditable.

Moreover, to couple the device of the invention for orienting the core samples, it comprises an inner tube adapter configured to couple the tubular body to the inner tube, and also comprises a head adapter configured to couple the tubular body to the head assembly. These adapters have been designed with the idea of maintaining the same dimension for the tubular body despite the different pipe diameters, that is, it is the inner tube adapter or the head adapter that, as its name indicates, is adapted to the diameter of the pipe in question. Therefore, each of these adapters comprises one end couplable to the tubular body and another end couplable to the inner tube or head assembly. In this sense, each device can have a kit of both inner tube adapters and head adapters to use the appropriate adapter according to the diameter of the pipe.

As mentioned, the orientation device of the invention is intended to transmit the obtained data of the breaking of the core sample and its orientation wirelessly via high-speed Bluetooth protocol therefore, as part of a system for orienting core samples relative to its position with respect to the subsoil before being extracted, the orientation device can be wirelessly paired by means of said high-speed Bluetooth protocol with a portable communication device, such as a Smartphone, Tablet or similar, in which the orientation data is received, the same is processed, and finally said orientation data of the extracted core sample is presented to a user.

As mentioned in previous lines, one of the advantages of the present invention is that it is not necessary to disconnect the orientation device from the inner tube or the head assembly to obtain the orientation data of the core sample, which lead to decreased operation time and less fatigue on the part of users.

Another noteworthy advantage is that the use of the device for orienting core samples of the invention does not modify or reduce the capacity of the pumping equipment since it has a valve intended for, in the event that the internal valve that is equipped in the head assembly is not operable or bypassed, maintaining normal functionality of said equipment.

BRIEF DESCRIPTION OF THE FIGURES

The foregoing and other advantages and features will be more fully understood from the following detailed description of exemplary embodiments with reference to the accompanying drawings, which should be considered by way of illustration and not limitation, wherein.

DETAILED DESCRIPTION OF AN EXEMPLARY EMBODIMENT

In the following detailed description, numerous specific details are set forth in the form of examples to provide a thorough understanding of the relevant teachings. However, it will be apparent to those skilled in the art that the present teachings can be implemented without such details.

Figure 1:
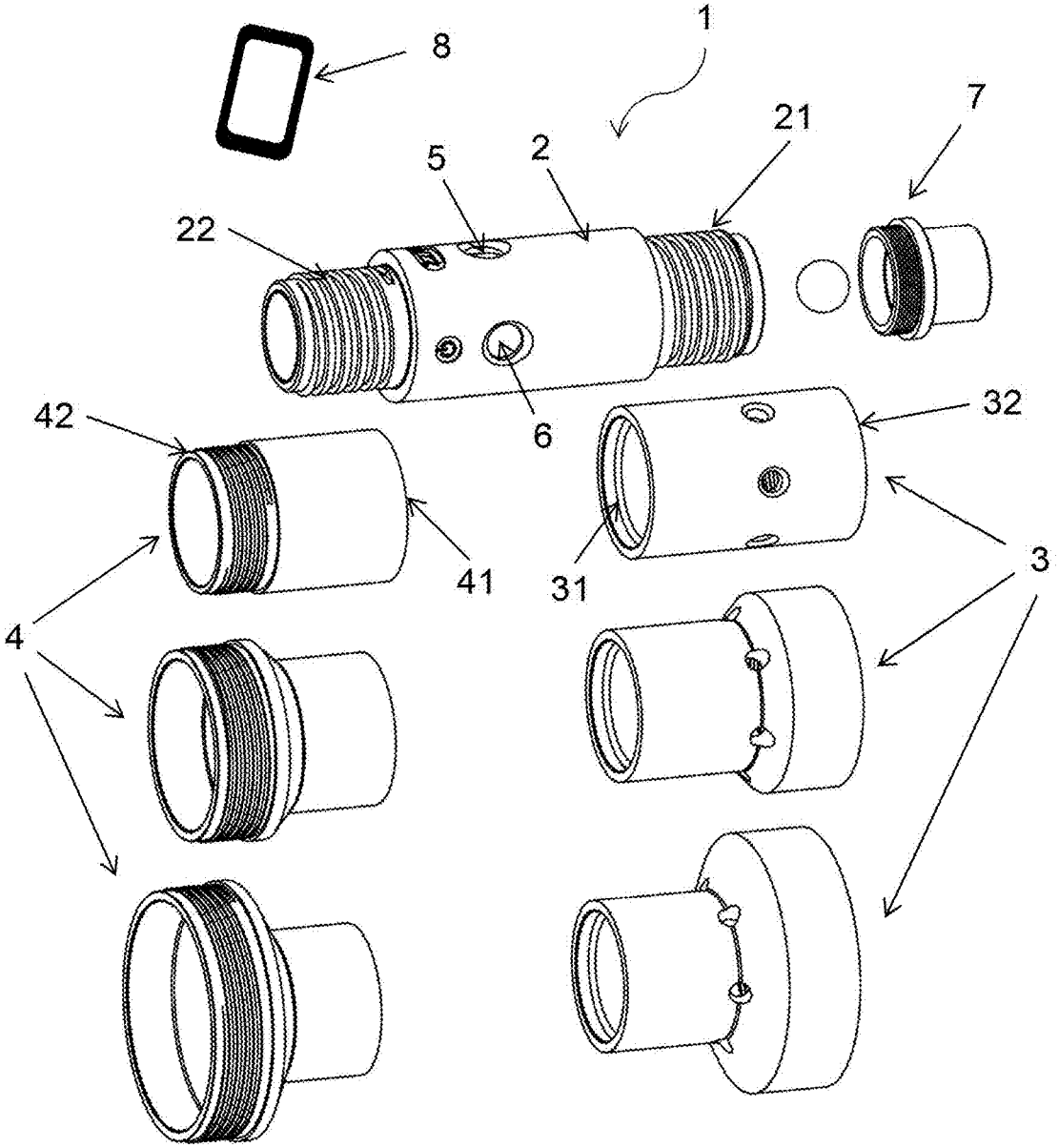
FIG. 1 is a perspective view of the device for orienting core samples of the invention in communication with a portable communication device.
Figure 2:
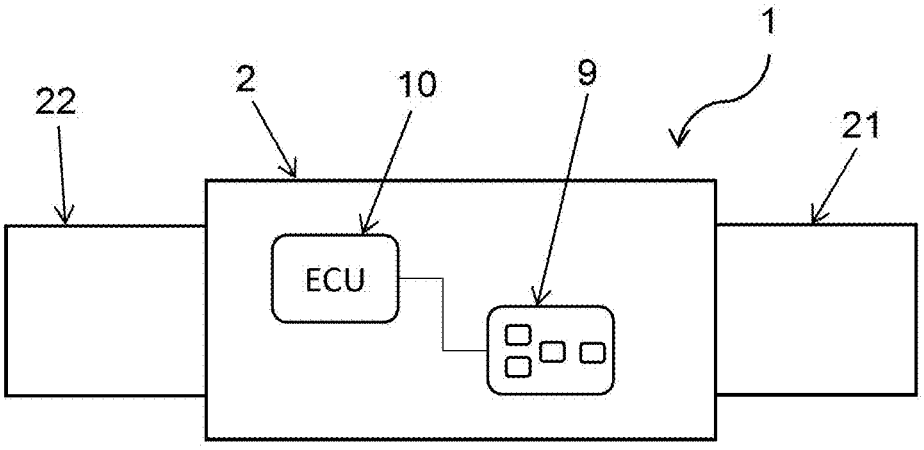
FIG. 2 is a plain view of the device for orienting core samples of the invention.

According to a particular embodiment, as shown in FIG. 1, the present invention provides a device (1) for orienting core samples relative to the position thereof with respect to the subsoil before being extracted, said device (1) comprising a tubular body (2), essentially cylindrical, this tubular body (2) being couplable to an inner tube (not shown) and/or to a head assembly (not shown) of a core bit (not shown). The tubular body (2) can be coupled to said elements by any known technique; however, to maintain a standard dimension of said tubular body (2) despite the different diameters of the inner pipe or head assembly, as seen in FIG. 1, the invention provides at least one inner tube adapter (3) configured to couple the tubular body (2) to the inner tube (not shown), and comprises at least one head adapter (4) configured to couple the tubular body (2) to the head assembly (not shown). Therefore, the tubular body (2) comprises a first coupling end (21) and a second coupling end (22) for the coupling of such adapters (3) (4) respectively. For ease of coupling, the coupling ends (21) (22) are threaded ends, in the embodiment shown they are male threaded ends, for the threaded coupling of the adapters (3) (4), female threads. The skilled in the art would see different combinations, as well as other forms of releasable coupling, are within the scope of the invention.

Each of these adapters (3) (4) comprises one end (31) (41) that can be coupled to the tubular body (2) and another end (32) (42) that can be coupled to the inner tube or to the head assembly. In this sense, each device (1) can have a kit or series of inner tube adapters (3) and head adapters (4) to use the appropriate adapter according to the diameter of the pipe.

Furthermore, the device (1) comprises a detector (9) arranged in the tubular body (2), the detector (9) is configured to detect a breaking of the core sample from the subsoil, i.e., the moment when the core sample is separated from the subsoil, and is also configured to detect an orientation of the inner tube and/or of the core sample disposed in the inner tube. In the preferred embodiment, the detector (9) comprises a set of three triaxial accelerometers arranged mutually orthogonal to each other, said set of triaxial accelerometers being configured to orient the core sample by means of measuring the gravity vector, and also, to record the vibrations and/or movements of the core bit, wherein the breaking of the core sample is recorded when the data of the vibrations and/or movements of the core bit are beyond a preset value that may associated with an event, e.g., the cessation of drilling. In any case the event may be indicative of an imminent core breakage. It is important to highlight that either or all of the triaxial accelerometers of the set is configured for the record of the vibrations and/or movements of the core bit. Alternatively, there is a set of three triaxial accelerometers arranged mutually orthogonal to each other to detect the orientation of the inner tube and/or of the core sample disposed in the inner tube, and at least a triaxial accelerometer, apart from the set, to record the vibrations and/or movements of the core bit.

Alternatively, this detector (9) comprises of a set of three gyroscopes, preferably MEMS, arranged mutually orthogonal to each other, by means of which it is possible to obtain the orientation with respect to true north of the extracted core sample.

In other embodiments, the detector (9) comprises of a set of three triaxial accelerometers arranged mutually orthogonal to each other and a set of three micromechanical gyroscopes arranged mutually orthogonal to each other. The different configurations of the detector (9) make it possible to determine the orientation of the core sample as it was located in the subsoil before being extracted, and at the same time, recording the precise moment where the core sample has broken from the subsoil, where this orientation data is exported for the geological analysis of the terrain.

The device (1) comprises an electronic control unit (10), ECU (10) hereinafter, arranged in the tubular body (2) configured to control the detector (9) and for receiving and processing data thereof relating to the breaking of the core sample and the orientation of the inner tube and/or the core sample placed in the inner tube, and to the wirelessly transmitting of the data, wherein the ECU (10) is also configured to store the data of the breaking of the core sample for further processing.

Preferably, the ECU (10) comprises a circular buffer configured to record the data related with the breaking of the core sample and a non-volatile memory configured to store said data. More particularly, the circular buffer has an adjustable frequency among the range of 1 Hz a 0.2 Hz to record the data.

Further, the ECU (10) comprises communication means (not shown) which, among others, comprise an antenna (not shown) for high-speed Bluetooth transmission to a suitable external terminal, such as, for example, a portable communication device (8) which is configured to establish wireless communication via high-speed Bluetooth protocol with the device (1), receive the data from the latter, process such data and present the orientation data of the extracted core sample to a user. So, once the head assembly and inner tube have been removed, without disassembling any element, orientation data of the core sample can be transmitted by establishing a high-speed Bluetooth wireless connection between the device (1) and the portable communication device (8).

As can be seen in FIG. 1, the device (1) comprises a connection indicator (6) configured to indicate the establishment of the connection between the device (1) and the portable connection device (8), as well as to indicate the transmission of data between said devices by means of, for example, a steady light when the connection has been made and a flashing light when data is being transmitted.

Likewise, the tubular body (2) comprises at least one opening (5), in particular at least a circular through hole carried out in the tubular body (2), provided for the transmission of the wireless connection signal via the communication means arranged inside said tubular body (2).

In preferred embodiments, the ECU (10) is provided with processing means, configured to process the measurements made by the detector (9) and obtain the orientation data of the core sample associated with the exact time when the core sample has been taken from the subsoil, wherein the portable communication device (8) may be a simple mean for the user to be able to view the orientation data, or, alternatively, when the device has been retrieved from the head assembly, the raw measurements or orientation data are transmitted directly to the portable communication device (8) which would be provided with processing means and software capable of processing the data received, obtaining the orientation of the extracted core sample and presenting it to the user.

As seen in FIG. 1, it comprises at the coupling end (22) a housing configured to receive a check valve (7), which, when activated cuts off the flow of fluid, raising the pressure in a pressure gauge arranged on the surface, acting as an indicator of the pumping pressure.

Furthermore, the ECU (10) alternatively comprises temperature detector, for example, a thermocouple, infrared sensor, a thermographic camera, or similar sensors, configured to measure the temperature of the bottom of the well, this data being relevant in some reservoirs or fields.

What is claimed is:

1. A device for detecting the orientation of a core sample relative to a position thereof with respect to a subsoil before being extracted, the device comprising:

a tubular body couplable to an inner tube or to a head assembly of a core bit;

a detector arranged in the tubular body configured to detect a breaking of the core sample from the subsoil, and also configured to detect an orientation of the inner tube or of the core sample provided in the inner tube; and an electronic control unit arranged in the tubular body configured to control the detector and for receiving and processing data thereof relating to the breaking of the core sample and the orientation of the inner tube and/or the core sample placed in the inner tube, and to the wirelessly transmitting of the data, wherein the electronic control unit is also configured to store the data of the breaking of the core sample for further processing, and wherein the electronic control unit comprises a circular buffer configured to record the data related with the breaking of the core sample and a non-volatile memory configured to store said data, wherein the circular buffer has an adjustable frequency to record the data, wherein the frequency is adjusted among the range of 1 Hz to 0.2 Hz.

2. The device according to claim 1, wherein the detector comprises at least a triaxial accelerometer configured to record the vibrations and/or movements of the core bit, wherein the breaking of the core sample is recorded when the data of the vibrations and/or movements of the core bit are beyond a preset value.

3. The device according to claim 1, wherein the detector further comprises a set of triaxial accelerometers, arranged mutually orthogonal to each other, configured to detect an orientation of the core sample by measuring a gravitational vector.

4. The device according to claim 1, wherein the detector comprises a set of micromechanical gyroscopes arranged mutually orthogonal to each other, configured to detect an orientation of the core sample with respect to the true north.

5. The device according to claim 1, further comprising an inner tube adapter configured to couple the tubular body to the inner tube.

6. The device according to claim 1, further comprising a head adapter configured to couple the tubular body to the head assembly.

7. A system for detecting the orientation of a core sample relative to a position thereof with respect to a subsoil before being extracted, the system comprising:

a device for detecting the orientation of the core sample; and a portable communication device for establishing wireless communication with the device, receiving an orientation data therefrom, processing the data and presenting the orientation data of the core sample to a user;

wherein the device comprises:

a tubular body couplable to an inner tube or to a head assembly of a core bit;

a detector arranged in the tubular body configured to detect a breaking of the core sample from the subsoil, and also configured to detect an orientation of the inner tube or of the core sample provided in the inner tube; and an electronic control unit arranged in the tubular body configured to control the detector and for receiving and processing data thereof relating to the breaking of the core sample and the orientation of the inner tube and/or the core sample placed in the inner tube, and to the wirelessly transmitting of the data, wherein the electronic control unit is also configured to store the data of the breaking of the core sample for further processing, and wherein the electronic control unit comprises a circular buffer configured to record the data related with the breaking of the core sample and a non-volatile memory configured to store said data, wherein the circular buffer has an adjustable frequency to record the data, wherein the frequency is adjusted among the range of 1 Hz to 0.2 Hz.

8. The system according to claim 7, wherein the detector comprises at least a triaxial accelerometer configured to record the vibrations or movements of the core bit, wherein the breaking of the core sample when the data of the vibrations or movements of the core bit are beyond a preset value.

9. The system of claim 7, wherein the detector comprises a set of triaxial accelerometers, arranged mutually orthogonal to each other, configured to detect the orientation of the core sample by measuring a gravitational vector.

10. The system of claim 7, wherein the detector comprises a set of micromechanical gyroscopes arranged mutually orthogonal to each other, configured to detect the orientation of the core sample with respect to the true north.

11. The system of claim 7, further comprising an inner tube adapter configured to couple the tubular body to the inner tube.

12. The system of claim 7, further comprising a head adapter configured to couple the tubular body to the head assembly.

* * * * *